United States Patent [19]

Sattler

[11] Patent Number: 4,984,391

[45] Date of Patent: Jan. 15, 1991

[54] MACHINE FOR FORMING WOODWORKING TOOL

[76] Inventor: Kenneth G. Sattler, 2839 SW. Sunset Trail, Palm City, Fla. 34990

[21] Appl. No.: 493,798

[22] Filed: Mar. 15, 1990

Related U.S. Application Data

[63] Continuation-in-part of Ser. No. 207,338, Jun. 15, 1988, abandoned.

[51] Int. Cl.[5] ..... B24B 7/00

[52] U.S. Cl. ..... 51/100 R; 51/91 BS; 51/92 BS; 51/285

[58] Field of Search ..... 51/91 BS, 92 BS, 101 R, 51/285

[56] References Cited

U.S. PATENT DOCUMENTS

| | | | |
|---|---|---|---|
| 563,105 | 6/1896 | Vivarhas | 51/100 R |
| 1,255,962 | 2/1918 | Warner | 51/100 R |
| 1,395,145 | 10/1921 | Robbins | 51/100 R |
| 1,704,855 | 3/1929 | Chase | 51/100 R |
| 2,498,012 | 2/1950 | Sjöstrand | 51/100 R |
| 2,633,676 | 4/1953 | Jeffries et al. | 51/100 R |
| 3,875,705 | 4/1975 | Gilley | 51/100 R |

*Primary Examiner*—J. J. Hartman

*Attorney, Agent, or Firm*—Richard C. Litman

[57] ABSTRACT

A grinding machine for grinding a woodworking tool shown as knife to a predetermined shape includes two main tables. The upper table moves toward and away in a Y direction from the grinding wheel and a lower table that moves left and right in an perpendicular X direction in relation to the face of the grinding wheel. The total of the two movements yielding a full, two dimensional planar movement. The upper table includes a movable holder for a template having the desired shape. A guide pin is mounted to a base plate that is also adjustable toward and away from the grinding wheel in a Y direction. The template on the upper table is engageable with the guide pin and is movable relative thereto in a full planar two dimensional motion to thus cause corresponding movement of the woodworking tool relative to a grinding wheel to grind desired shape into the woodworking tool. The grinding wheel is positioned to first engage the cutting edge of the tool or knife in a face up position. The operator standing in front of the machine views the cutting edge of the tool or knife in a face up position and the template as an exact replica as it would be running on the machine spindle. Prior art presents a 180° mirror image from the present invention. In such prior art, the operator has to reverse his mental image of the machine spindle as he is viewing it.

4 Claims, 4 Drawing Sheets

MACHINE FOR FORMING WOODWORKING TOOL

CROSS-REFERENCE TO RELATED APPLICATIONS

This present application is a Continuation-In-Part Application of patent application No. 07/207,338 filed June 15, 1988, now abandoned.

BACKGROUND OF THE INVENTION

This invention relates to a grinding machine to grind a tool to a predetermined shape to cut a desired shape into a piece of wood by first engaging the grinding wheel with the tool in the face-up position.

The process of making a woodworking tool, such as a knife or the like, to cut a given shape in a piece of wood involves two basic steps: making a template having the exact shape as the wood product; and grinding the front of the knife in the face up position. However, since the angle at which the knife strikes the wood varies as the depth of cut changes, the exact shape desired to be cut into the wood cannot be ground into the knife. Accordingly, such factors as the depth of the cut to be made and the angular relationships of the knife relative to the wood during the cutting process must be taken into account. Therefore, the knife is ground with a deeper contour than that of the template or the piece of wood, because the knife is disposed at an angular relationship in the cutterhead relative to the wood. The apparatus of this invention automatically scribes the elongation in the knife. Prior art devices such as U.S. Pat. No. 1,395,145 disclose grinders that make use of a template, but fail to automatically take into account the elongation necessary when cutting the knife blank. A special template has to be prepared for machines of this type. There is no adequate ability in this type of machine to rotate the knife blade in relation to the grinding wheel in order to produce the required pattern elongation.

Because of the angular relationships between the knife and the piece of wood in the prior art a template had to be experimentally designed by hand so that the machine would grind the knife to cut the desired shape in the wood, and the template did not have the same shape as the desired shape of the wood. This present device automatically calculates the error caused by the knife being held in the off center position in the cutterhead. Thus the profile of the wood and the template are identical. The present apparatus allows the operator to view the template and the upper face of the tool being ground at the same time and in an identical face up relationship, not a mirror image as in other prior art. This is accomplished by mounting the cutting tool or knife blade onto the tool holder with the knife face up. The tool holder is then placed on a workshaft, it then being mounted on bearings on top of support devices. A counterweight, when lifted off a support, is locked in a higher position by turning the counterweight clockwise which makes the counterweight arm and work arbor holding the knife support move as one unit. The downward weight rotates the knife under a guide finger to change the angle of grind as you go deeper into the pattern. It allows you to blend your grinding clearance caused by the knife being held in the cutterhead in the off center position. If the knife face was on the same centerline of the cutterhead you would not need to stretch the knife profile. Ninety-nine percent (99%) of all woodworking tools incorporate the off center principle. Hence the elongated pattern has to be ground in the knife. The greater the off center, the greater the elongation needed.

The relationship of the template and pin relative to the knife results in the knife actually moving a greater distance than the actual depth of cut to be made in the wood and the knife is accordingly ground deeper than the actual depth of the template, which the guide pin follows. Accordingly, the knife is automatically ground to the desired shape to compensate for the difference in angle of the knife relative to the piece of wood as the depth of cut changes, and the exact shape to be formed is therefore easily obtained without requiring time consuming and complicated hand design methods.

In the present invention the template is viewed along with the knife in a face-up position by the operator, this being the identical position its mounted on the cutterhead spindle. The operator does not have to view the knife face-down as in the other prior art devices, which would present the knife and the template in mirror image relationship.

SUMMARY OF THE INVENTION

A grinding machine for grinding a woodworking tool such as a knife or cutter to a predetermined shape includes three main tables. The upper table moves toward and away in a Y direction and in a full planar two dimensional motion from the grinding wheel and lower table that moves left and right in an X direction normal to the Y direction in relation to the face of the grinding wheel. The upper table includes an adjustable holder for a template having the desired shape. A guide pin is mounted to a base plate that is also adjustable toward and away from the grinding wheel in a Y direction. The template on the upper table is engageable with the guide pin and is movable relative thereto in full two dimensional planar motion to thus cause corresponding movement of the woodworking tool relative to a grinding wheel to grind the desired shape into the woodworking tool. The grinding wheel is positioned to engage the cutting edge of the tool or knife in a face up position. The operator standing in front of the machine views the cutting edge of the tool or knife in a face up position and the template as an exact replica of the cutting edge being cut in the tool or knife and as it runs on a woodworking machine spindle.

Accordingly, it is an object of this invention to provide a grinding machine for grinding a woodworking tool, such as a knife or the like, to grind a desired shape into a piece of wood, and wherein the apparatus includes means for positioning the knife relative to the grinding wheel such that the desired shape is ground into the knife in a face up position while viewing the template in the exact orientation as the cutter head would be mounted on a woodworking machine spindle.

Another object of the invention is to provide a grinding machine for grinding a knife or similar tool to cut a desired shape into a piece of wood, and wherein the machine includes means for automatically mechanically grinding the knife to the desired shape without requiring experimenting with template shape and complicated viewing of the knife in the reverse as in other prior art devices.

It is a further object of this invention to provide a machine wherein the grinding wheel is rotating into the cutting edge of a knife being held in the face up position.

It is also providing a full face up view of the template which has the desired wood shape. By having the grinding wheel rotate into the cutting edge instead of "off" the cutting edge, as in the prior art, it leaves no burr, which is a jagged edge that would have to be removed by a handheld slip stone.

In accordance with these and other objects which will be apparent hereinafter, the instant invention will now be described with particular reference to the accompanying drawings.

BRIEF DESCRIPTION OF THE DRAWINGS

Similar reference characters denote corresponding features consistently throughout the attached drawings.

A DETAILED DESCRIPTION OF THE PREFERRED EMBODIMENT

Figure 1:
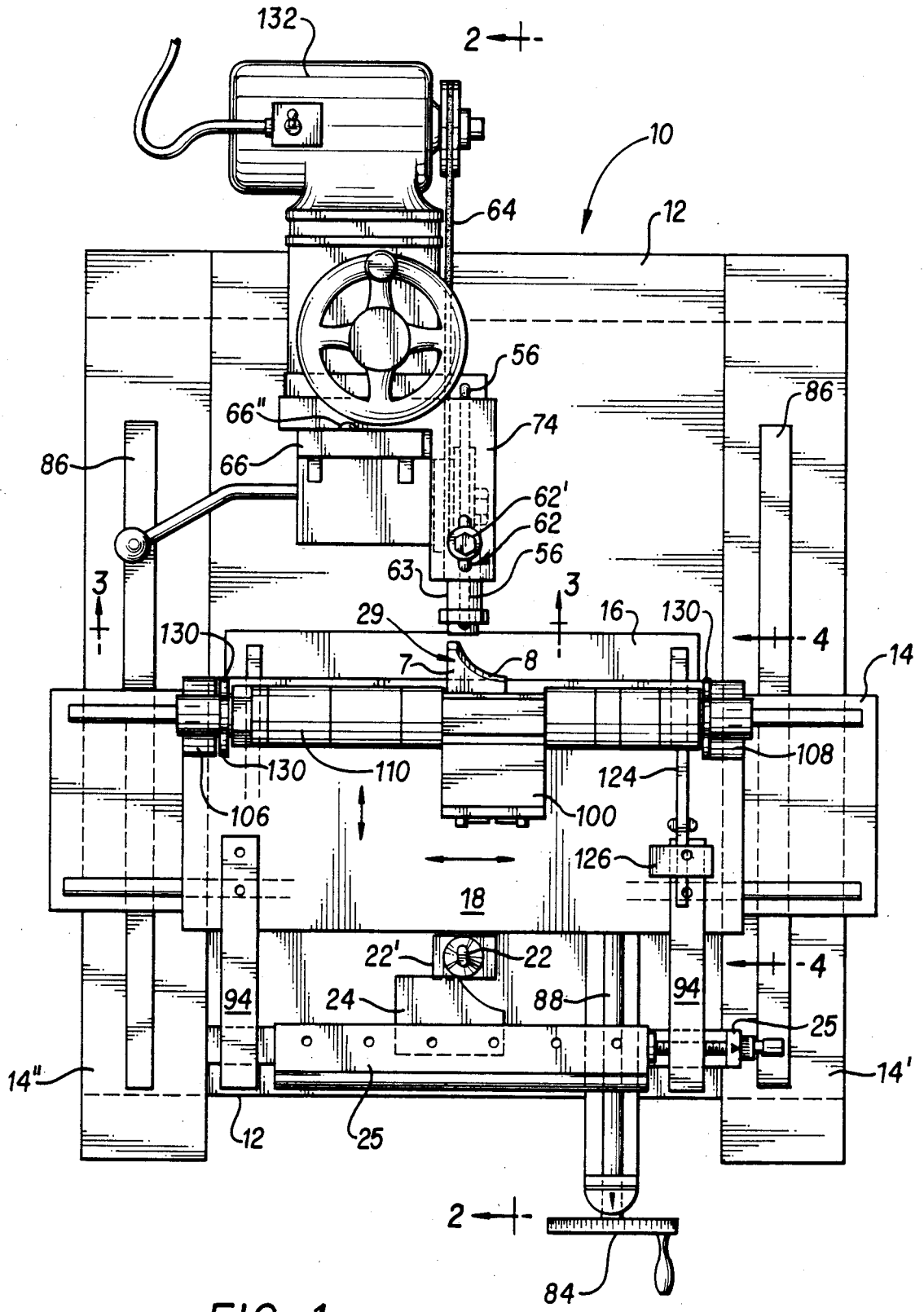
FIG. 1 is a top perspective view of the grinding machine according to the invention.
Figure 2:
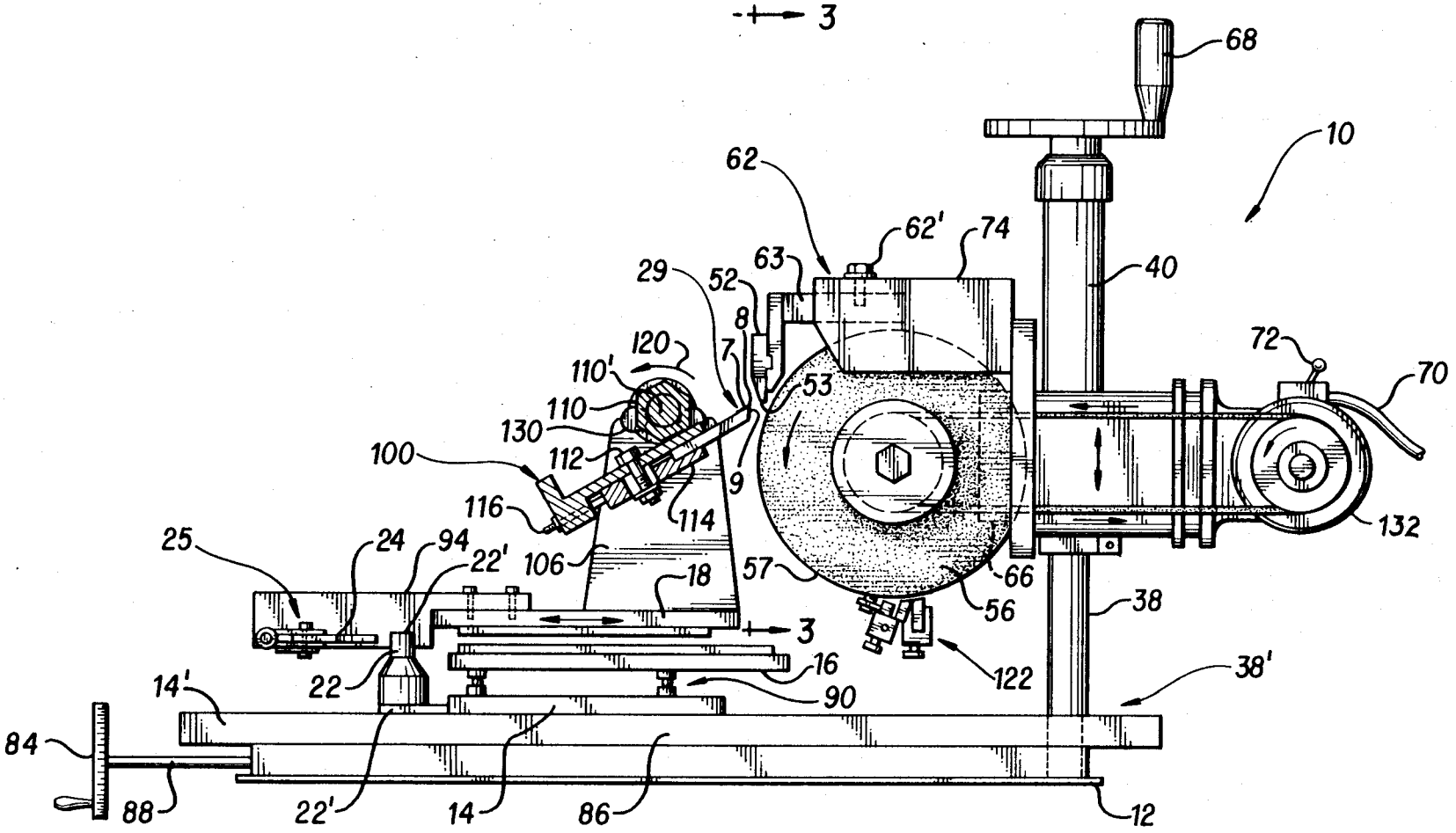
FIG. 2 is a side view in elevation of the attachment of FIG. 1 with the tool portion in cross section taken along lines 2—2 in FIG. 1, looking in the direction of the arrows.

The new and improved invention is shown in FIGS. 1 and 2, the grinding machine 10 is shown for grinding a woodworking tool shown as knife 29 with a top face 7 and cutting edge 8 to provide a predetermined shape. The grinding machine 10 includes two main tables 18 and 16. The upper table 18 moves toward and away from the grinding wheel in a Y direction and moves in a two dimensional planar motion and a lower table 16 that moves left and right in a perpendicular X direction in relation to the grinding face 57 of the rotating grinding wheel 56. The combined motion of upper table 18 and lower table 16 allows for full two dimensional planar motion of a template 24. The upper table 18 includes a movable holder 100 for knife 29 and a template 24 having the desired shape to be cut into the knife. A guide pin 22 is mounted to a base plate 14 that may be adjustable toward and away from the grinding wheel in relation to a ground support 12. The template 24 is engageable with the guide pin 22 and is movable relative thereto to thus cause corresponding movement of the woodworking tool 29 relative to a grinding wheel 56 to grind the desired shape into the woodworking tool. The grinding wheel 56 is positioned to first engage the cutting edge 8 of the tool edge 9 as shown in FIG. 1. The operator standing at numeral 25 in FIG. 1 in the first drawing views the cutting edge 8 of the tool 29 positioned face up and the template 24 as an exact replica of the cutting edge 8 being cut and not the mirror image as used in conventional devices.

The grinding portion is to the right in FIG. 2 and includes the grinding wheel 56 driven by belt 64 and electrical motor 132, a guide finger system including guide finger 52 with an arcuate adjusting means 53 that includes a seat and a bolt that may be adjusted to adjust the angular position of the finger face 52 and an in and out slotted adjusting means 62 on housing 74 that includes a bolt 62' for adjusting the position of the arm 63 supporting the finger 52 that is also slidably connected on housing 74, all of which is mounted on motor support base 38. The in and out movement of arm 63 is used after the grinding wheel is dressed or to accommodate different sized wheels. The grinding wheel 56 and motor 132 are mounted on a frame member connected to vertical support member 38 that slides up and down over the motor support base 38' and may be moved up and down through crank handle 68 connected to a screw mechanism 40 inside motor support column 38. The electrical motor is connected to an electrical power source by line 70. Switch 72 turns motor 132 on and off. The grinding wheel 56 is rotated in the direction shown by the arrow in FIG. 2, into the cutting edge 8 of the blade 29. The grinding wheel is connected to the support member 78 by nut 76. The support member 78 is adjustable in an arc by curved keyway 66' as shown by arrows 80 in FIG. 3 to move the grinding wheel at pivot point 52' for undercutting the tool face in certain situations. The adjustment is held in position by bolts 66''.

The tool holding portion is positioned to the left in FIG. 2 and the bottom of FIG. 1. The whole tool portion with guide pin 22 along with tables 18 and 16 may be moved toward and away from the grinding portion by moving the third table 14, 14', 14'' and turning hand wheel 84. Motor support base post 38 is secured to ground support 12 in a fixed position. The base post 38 is positioned between tracks 86. The tracks 86 are connected between table 14 and ground support member 12. The tracks in this case are preloaded linear ways, that provide no play. They should be well lubricated to allow for ease of movement. Tables 16 and 18 are also fastened to tables 14, 14' and 14'' by linear ways 90 and 92. Crank 84 and screw 88 is used to adjust the position of movable base plate 14 or the third table. The guide pin 22 and base 22' are connected to base plate 14. The guide pin 22 is fixed in relationship to base plate 14 through plate 22'. Crank 84 allows guide pin 22 to be positioned along with the whole system including the tables 16 and 18, at a particular location in relationship to the grinding wheel 56. Table 16 with tracks 90 and table 18 with perpendicularly positioned tracks 92 allow table 18 to be moved in full two dimensional planar motion. This motion allows template 24 connected to table 18 through template holder 25 and arms 94 to be moved in any direction about guide pin 22.

The knife 29 shown in FIGS. 1 and 2 is mounted on tool holding means shown by numerals 100 in FIGS. 1 and 2. Alternatively, knife 118 is mounted on tool holding means 102 in FIG. 5. The tool holding means 100 in FIGS. 1 and 2 include two vertical supports 106 and 108 mounted on table 18. Rotatable horizontal tool holder assembly 110 rotates on supports 106 and 108 by means of bearings 130. The tool holder means 100 and clamp 114 includes bolt 112 that secures knife 29 to the tool holder with clamp 114. Adjusting screw 116 moves knife for forward adjustment.

Figure 3:
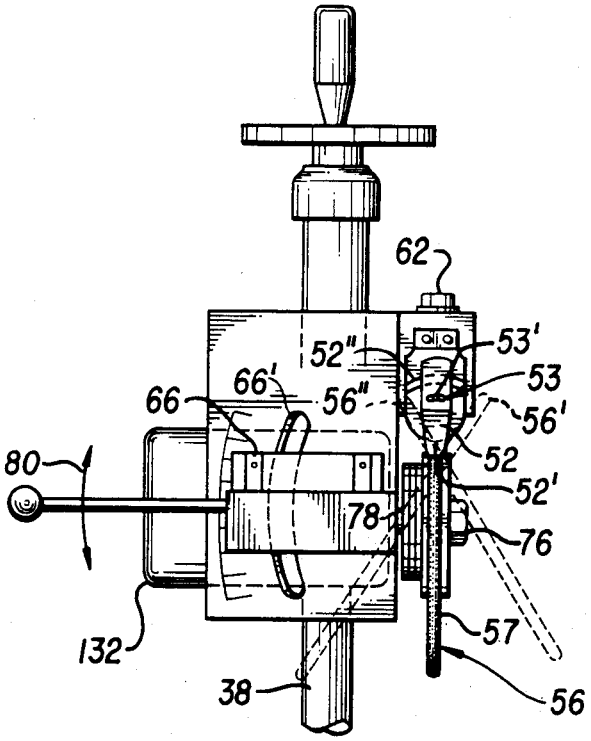
FIG. 3 is a front view of the grinding wheel portion with a pivot point at the arrow point on edge 52'.
Figure 5:
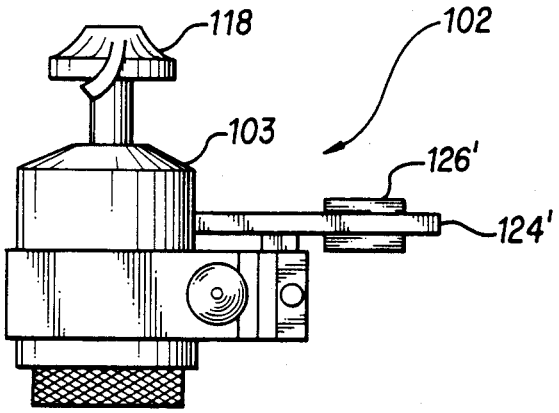
FIG. 5 is a top view of a collet holder for holding a shank type tool.

Alternatively, the tool holding means 102 in FIG. 5 holds collet 103, which is a 5c collet, which is another means for mounting cutters 118 on table 18 for grinding angled knife faces with a shank on it. In FIG. 3 the grinding wheel is shown in phantom as 56' and 56''.

In use the template 24 is secured by clamp bar 25 to table 18. The template holder 25 is adjustable by means of a micrometer screw 25' for set up purposes. The guide pin is adjusted in relationship to the grinding wheel by crank 84. The knife 29 or 118 moves in an identical relationship to the template - guide pin movement. The template is a picture of the eventual wood cut to be made as viewed by the user and as shown in FIG. 1. The grinding wheel first engages the visible leading edge 8 of the tool positioned face up and then moves across and grinds down the tool edge 9.

The tool edge 9 is moved into engagement with the face 57 of grinding wheel 56. The upper portion 7 of the knife 29 is placed under the lower edge of finger 52. The point of the arrow head 52′ shown in FIG. 3 shows the pivot point of member 52 rotating about the arc 52″. This is the same pivot point of member 78 and grinding wheel 56 rotating about the arc 66′. The arc of 78 is guided by keyway 66′. The finger 52 holds the knife in a grinding position. The finger is adjustable to vary the position of lower edge of the finger 52 from the horizontal position as illustrated in FIG. 3 to a tilted position. This may be moved separate from the movement of grinding wheel 56 to position 56′ or 56″ about arc 66′ or the arrow head point 52′. The finger moves on arc 52″ about arrow head point 52′ and secured by a bolt 53′.

Figure 4:
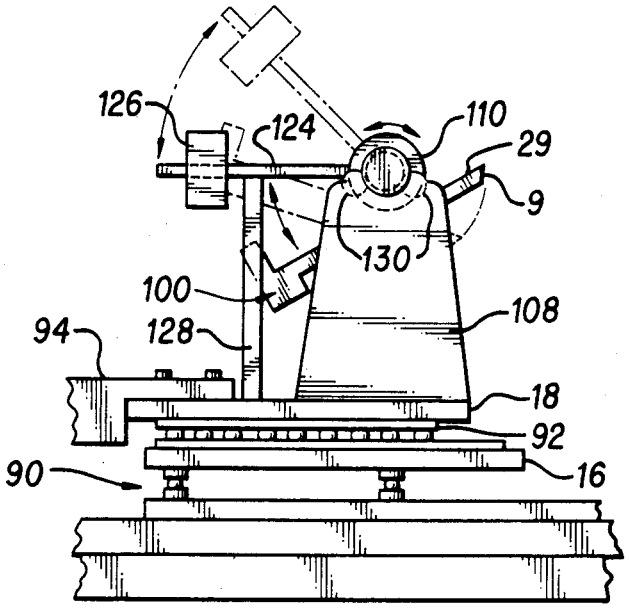
FIG. 4 is a side view of the tool holding portion taken along lines 3—3 in FIG. 2 looking in the direction of the arrows.
Figure 6:
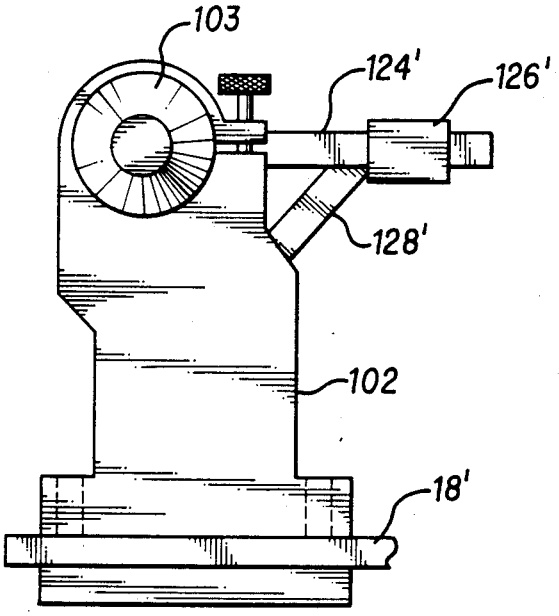
FIG. 6 is a left side view of the collet holder.

To prevent the knife 29 and 118 from moving down into the wheel due to the initial engagement of the grinding wheel moving downward the horizontal rotatable tool holder 100 mounted on tool holding bar 110 and tool holder 102 is controlled by arm 124 with counterweight 126 that is adjustable along the longitudinal length of arm 124. Arm 124 rests on post 128, when not in grinding mode, which is connected to table 18. Tool holding bar 110 rotates freely until arm 124 is locked into central shaft 110′ by tightening arm 124. Any tendency for the tool edge 9 to move downward as shown in FIG. 4 is met by the weight 126 on arm 124 as shown in phantom in FIG. 4. This mechanism aids the operator during initial engagement of the knife face against the grinding wheel 56 and under finger 52 to accomplish the stretching action. The deeper one goes into the pattern of the template 24, the greater the rotation of the holding bar 110 and the greater the elongation of the pattern on the knife 29. This same arm arrangement for holder 102 is shown in FIG. 6 with arm 124′ and weight 126′. The arm 124′ and weight 126′ and post 128′ operate the same as arm 124 and weight 126 and post 128.

The tool 29, when ground, is placed against the grinding wheel 56 and under finger 52. Tool 118 is also placed under finger 52 when grinding with the embodiment shown in FIG. 5.

The grinding wheel may be dressed by dressing means 122 connected to spindle base plate 66. The grinding wheel dressing tool 122 allows the grinding wheel face to be ground the same shape of pin 22. The dressing tool also cuts the grinding wheel width to the proper dimension that is equal to the width of pin 22.

The arrow point 52′ in FIG. 3 is the rotating point for movable finger 52 to accommodate angle faced cutters 29–118. Arrow point 52′ also is rotating point for wheel 56 mounted on spindle base plate 66 guided by curved keyway 66′ for clearance settings. The movement of finger 52 about the arrow point in FIG. 3 is made when an operator wants to grind a tool that has a face bevel instead of flat face and movement of grinding wheel 56 about arrow point 52′ is done when the operator wants to grind clearance into knife pattern. The movement of finger 52 and movement of grinding wheel 56 may be done independently of each other due to the separate adjusting mechanisms.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. A grinding machine, including:

grinding wheel support means, said support means for housing a rotatable grinding wheel with a leading edge driven by a drive means, and further including an adjustable guide means secured to said grinding wheel support, said guide means positioned adjacent said grinding wheel to place a knife blank in correct alignment with said grinding wheel, said adjustable guide means being pivotably mounted about a pivot point in relation to said grinding wheel and having a solitary point disposed over the leading edge of said grinding wheel that remains stationary as said adjustable guide means pivots, said solitary point being a center of rotation;

at least one movable table disposed below said grinding wheel support means and including a tool holding means adjustably connected to said movable table;

said tool holding table movable, including full two dimensional planar movement, with respect to said grinding wheel and operably positioned for grinding a knife secured within said tool holding means, said tool holding means further including an adjustable template holding means;

a template guide means positionable in a fixed operational relationship with respect to said grinding wheel;

said template holding means operably positioned adjacent said template guide means for engagement with said template guide means;

said tool holding means positioned in front of said grinding wheel for securing a knife face-up for engagement with said grinding wheel, said tool holding means and said grinding wheel positioned to first engage an upper leading edge of said knife face prior to said grinding wheel completing its operation, said grinding wheel grinding into the said knife leading edge, said tool holding means having a rotating upper section that contains said knife, said rotating section rotating relative to an axis parallel to an axis of movement of said movable table and normal to a longitudinal axis of said grinding wheel support means;

a pivot point for rotating said grinding wheel support means about an axis parallel to an axis of movement of said movable table and normal to the axis of rotation of said grinding wheel and disposed through said solitary point, said pivot means enabling said grinding machine to provide for clearance when operating upon said knife blank; wherein said solitary point is the pivot point for the adjustable guide means and the pivot point for the grinding wheel support means;

wherein said upward facing knife and said template are viewed by the operator in exact orientation as on a woodworking machine, thus no mirror image movements interfere with the operator as he forms his desired pattern; and wherein said grinding machine grinds knife edges which have face angles in a straight on fashion, thereby providing a blade orientated during the grinding process as actually utilized when subsequently cutting a wood object.

2. The grinding machine according to claim 1, wherein:

said tool holding means includes a rotating tool holding bar disposed between a plurality of tool support posts which are disposed atop said movable table.

3. The grinding machine according to claim 1, wherein:

said tool holding means includes a single tool support having a collet assembly for supporting tools with shanks 4. The grinding machine according to claim 1, including:

stabilizer means for said tool holding means comprising an elongated arm attached to said rotating upper section and extending outward from said tool holding means, said arm having a counterweight disposed on a distal end such that the counterweight counteracts the initial tendency of said tool or knife to follow down into said grinding wheel upon initial contact and holds the knife under said adjustable guide means to produce the necessary elongation in the pattern.

* * * * *